US008534417B2

(12) United States Patent
Lam et al.

(10) Patent No.: US 8,534,417 B2
(45) Date of Patent: Sep. 17, 2013

(54) APPARATUS AND METHOD FOR PROVIDING PROTECTIVE GEAR EMPLOYING SHOCK PENETRATION RESISTANT MATERIAL

(75) Inventors: Tai Anh Lam, Kent, WA (US); Victor S. Starkovich, Maple Valley, WA (US)

(73) Assignee: The Boeing Company, Chicago, IL (US)

( * ) Notice: Subject to any disclaimer, the term of this patent is extended or adjusted under 35 U.S.C. 154(b) by 579 days.

(21) Appl. No.: 12/780,502

(22) Filed: May 14, 2010

(65) Prior Publication Data

US 2011/0277201 A1 Nov. 17, 2011

(51) Int. Cl.
*F16F 7/00* (2006.01)

(52) U.S. Cl.
USPC ..... 181/207; 2/2.5

(58) Field of Classification Search
USPC ..... 181/207; 2/2.5
See application file for complete search history.

(56) References Cited

U.S. PATENT DOCUMENTS

| | | | | |
|---|---|---|---|---|
| 4,608,717 | A * | 9/1986 | Dunbavand | 2/2.5 |
| 4,716,594 | A * | 1/1988 | Shannon | 2/4 |
| 4,748,064 | A * | 5/1988 | Harpell et al. | 428/113 |
| 5,090,053 | A * | 2/1992 | Hayes | 2/2.5 |
| 6,109,338 | A * | 8/2000 | Butzer | 165/46 |
| 8,087,101 | B2 * | 1/2012 | Ferguson | 2/455 |
| 2012/0174748 | A1 * | 7/2012 | Landi | 89/36.02 |

OTHER PUBLICATIONS

Ultrasonic Metamaterials with Negative Modulus, [online] [retrieved Jul. 15, 2010]. Retrieved from the Internet: <URL: http://esciencenews.com/articles/2008/11/25/the.physics.explosives.and.blast.helmets>. 2 pages.

The Physics of Explosives and Blast Helmets, [online] [retrieved Jul. 15, 2010]. Retrieved from the Internet: <URL: http://www.nature.com/nmat/journal/v5/n6/abs/nmat1644.html>. 2 pages.

Waves in Composites and Metamaterials/Acoustic Metamaterials and Negative Moduli, [online] [retrieved Jul. 15, 2010]. Retrieved from the Internet: <URL: http://en.wikiversity.org/wiki/Waves_in_composites_and_metamaterials/Acoustic_metamaterials_and_negative_moduli>. 8 pages.

First Acoustic Metamaterial "Superlens" Created, ScienceDaily (Jun. 25, 2009), [online] [retrieved Jul. 15, 2010]. Retrieved from the Internet: <URL: http://www.sciencedaily.com/releases/2009/06/090624153116.htm>. 2 pages.

* cited by examiner

*Primary Examiner* — Forrest M Phillips
(74) *Attorney, Agent, or Firm* — Alston & Bird LLP

(57) ABSTRACT

A method for providing a shock penetration resistant apparatus may include providing an item of protective gear to be positioned proximate to an object to be protected, and disposing a shock penetration resistant material proximate to the item of protective gear to attenuate or redirect shock pulses away from the object to be protected. An apparatus is also provided that may include an item of protective gear and a shock penetration resistant material. The item of protective gear may be configured to be positioned proximate to an object to be protected. The shock penetration resistant material may be disposed proximate to the item of protective gear to attenuate or redirect shock pulses away from the object to be protected.

13 Claims, 8 Drawing Sheets

APPARATUS AND METHOD FOR PROVIDING PROTECTIVE GEAR EMPLOYING SHOCK PENETRATION RESISTANT MATERIAL

TECHNOLOGICAL FIELD

Embodiments of the present disclosure relate generally to protective gear and, more particularly, to a method and apparatus for employing shock penetration resistant material (e.g., acoustic metamaterial or selected layered materials) in protective gear.

BACKGROUND

Modern warfare planners and strategists, much like warfare planners and strategists throughout the centuries, are continually looking to technology to provide opportunities to improve the effectiveness of weapons and also to improve the safety and security of the troops that employ them. For many centuries, personnel protective gear such as shields, helmets and armor have been developed and enhanced. The strength and weight of materials often became the focal issues of concern in relation to development of weapons and protective gear. Particularly for protective gear, design concerns focused on striking a proper balance between the amount of protection that could be provided and the amount of mobility that could simultaneously be afforded. More recently, weapons and personnel carriers themselves have also been designed with protective gear such as armor that is meant to preserve the battle effectiveness of the weapon and also protect those employing the weapon or being transported in the personnel carriers.

Modern protective gear reached a stage where casualties among law enforcement personnel and military personnel expecting to enter the line of fire of small arms have been noticeably reduced. The image of police and military personnel with helmets and body armor has been popularized in the media and such protective gear has undoubtedly saved numerous lives and reduced the severity of many injuries. However, small arms fire is not the only danger that faces modern military and security forces. For example, roadside bombs and improvised explosive devices (IEDs) are becoming common threats of concern. While typical modern protective gear may be useful in providing protection from fragments and shrapnel produced by these weapons, there is some question about the effectiveness of this gear with respect to the concussive forces produced by the blast wave that is generated by bombs and IEDs. Brain injuries and internal organ damage may still occur in situations where body armor or a helmet actually prevents penetration of fragments or shrapnel. In fact, some studies suggest that current helmets may actually act as an acoustic lens and focus shock waves (e.g., on the far side of the head), which could actually increase the severity of a brain trauma injury.

Accordingly, it may be desirable to provide protective gear that may overcome some of the issues described above.

BRIEF SUMMARY

Some embodiments of the present disclosure relate to protective gear that may provide improved performance with respect to shockwave injuries by reducing or even eliminating shockwave propagation inside the protective gear. In this regard, some embodiments may provide for the use of shock penetration resistant material (e.g., acoustic metamaterial or layered materials with selected different densities and thicknesses) in connection with personnel or equipment related protective gear. Embodiments may therefore provide a gradient index, for example, via selection of layered materials or via one or both of a negative elastic modulus or a negative effective density, which renders the protective gear an effective attenuator or redirector of shockwaves.

In one example embodiment, a method for providing a shock penetration resistant apparatus is provided. The method may include providing an item of protective gear to be positioned proximate to an object to be protected, and disposing a shock penetration resistant material proximate to the item of protective gear to attenuate or redirect shock pulses away from the object to be protected.

In another example embodiment, an apparatus is provided. The apparatus may include an item of protective gear and a shock penetration resistant material. The item of protective gear may be configured to be positioned proximate to an object to be protected. The shock penetration resistant material may be disposed proximate to the item of protective gear to attenuate or redirect shock pulses away from the object to be protected.

The features, functions and advantages that have been discussed can be achieved independently in various embodiments of the present disclosure or may be combined in yet other embodiments, further details of which can be seen with reference to the following description and drawings.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

FIG. 1, which is defined by FIGS. 1A and 1B, shows propagation of acoustic waves across an interface according to an example embodiment;

FIG. 2, which is defined by FIGS. 2A, 2B and 2C, illustrates an acoustic metamaterial of one example embodiment;

Figure 8A:
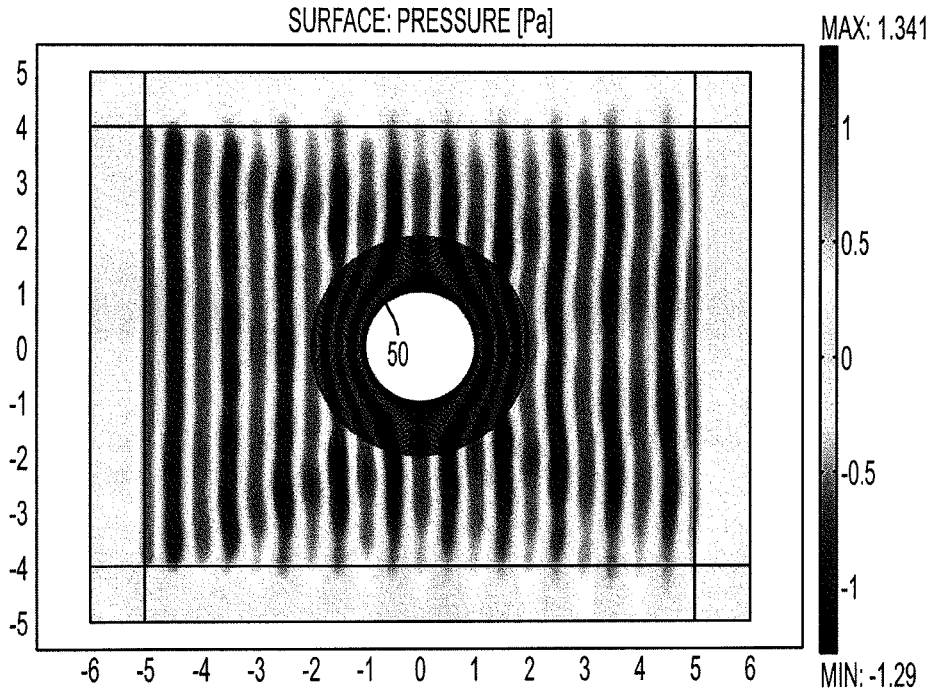
Figure 8B:
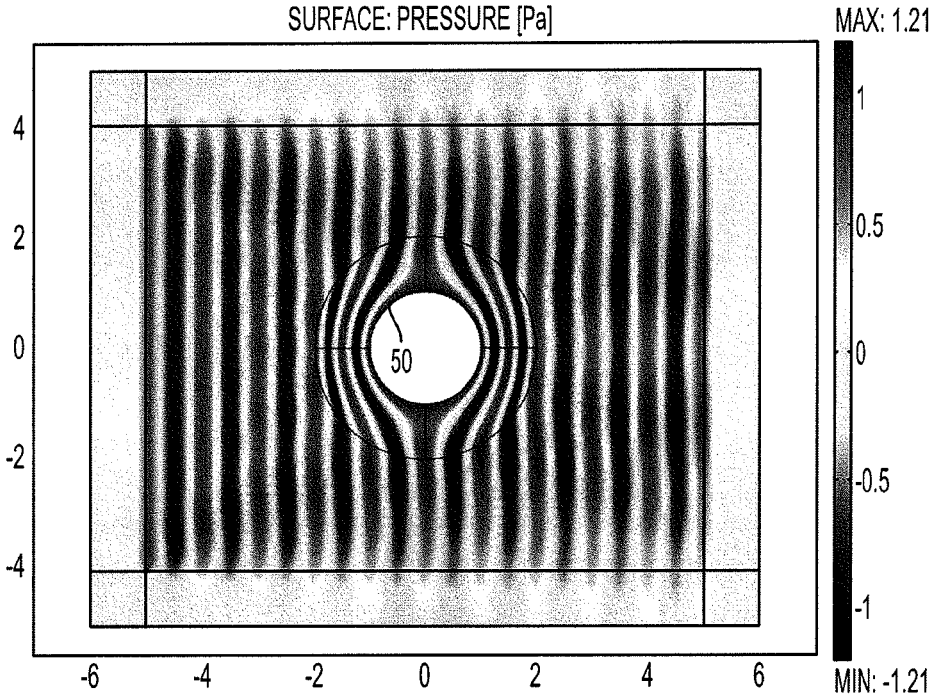
Figure 9:
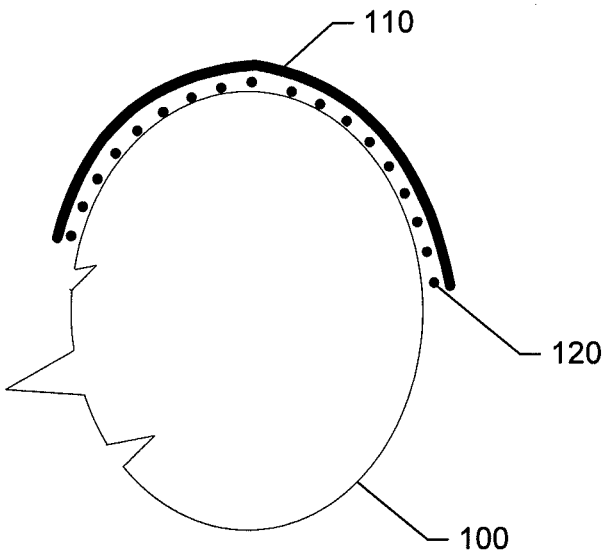
Figure 10:
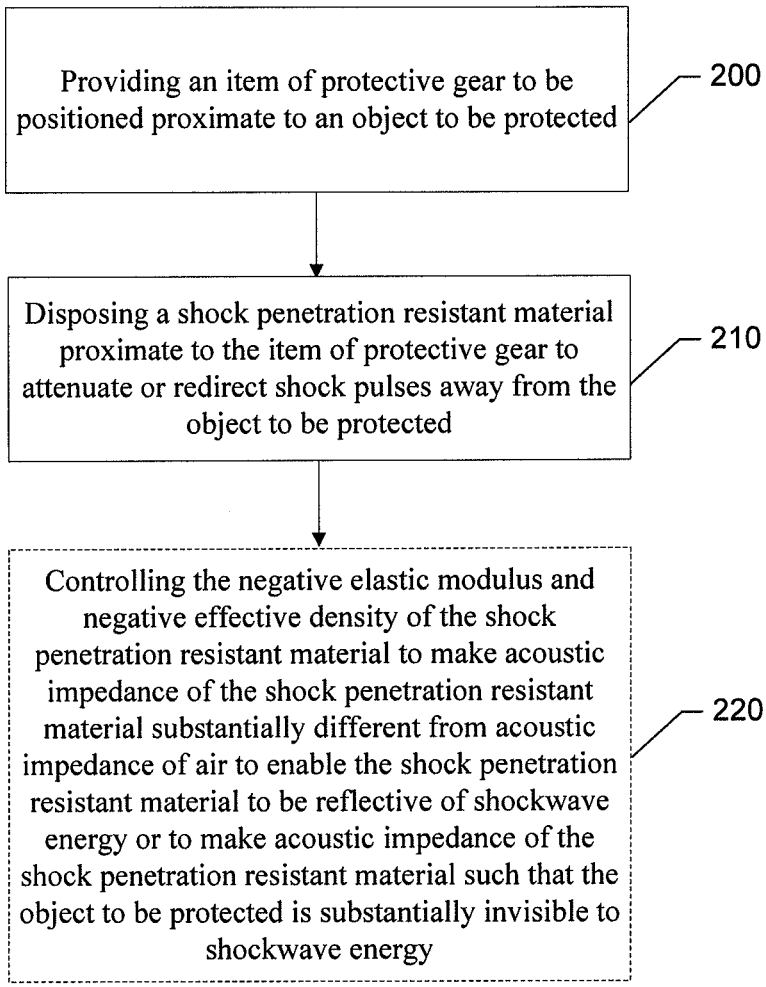

FIG. 8, which is defined by FIGS. 8A and 8B, shows corresponding example realizations of a cloaking helmet with corresponding different numbers of layers of material alternating between more and less dense material with corresponding selected thicknesses to define a shock penetration resistant material according to an example embodiment;

FIG. 9 illustrates a diagram showing a portion of a human body as a protected object that is equipped with protective gear according to an example embodiment; and FIG. 10 illustrates a method of providing protective gear that has improved effectiveness against shock pulses and bomb blasts according to an example embodiment.

DETAILED DESCRIPTION

The present disclosure now will be described more fully hereinafter with reference to the accompanying drawings, in which some, but not all embodiments are shown. Indeed, this disclosure may be embodied in many different forms and should not be construed as limited to the embodiments set forth herein; rather, these embodiments are provided so that this disclosure will satisfy applicable legal requirements. Like numbers refer to like elements throughout.

As discussed above, protective gear such as helmets, vests or other body armor garments may implement embodiments of the present disclosure to improve the effectiveness of the protective gear at attenuating or redirecting blast or shockwaves. Example embodiments may also be used in connection with providing armor or protection to robots or vehicles. As such, any type of protective gear including helmets, shields, gauntlets, garments, vests, gloves, shin guards, knee pads, elbow pads, armor (for body parts, vehicles or machines), and/or the like, may employ example embodiments of the present disclosure. In some cases, a shock penetration resistant material may be used in connection with the protective gear to make the protective gear more effective in protecting the person, component (e.g., electrical or mechanical) or machine being protected from shockwave propagation. In some examples, the shock penetration resistant material may be added to a protective item, while in others, the protective item may be formed of the shock penetration resistant material itself.

Conventional protective gear often employs metals, ceramics and/or synthetic fiber materials (e.g., Kevlar) to provide protection for body parts and/or equipment. While the metals, ceramics and synthetic fiber materials are typically very effective at stopping or blunting the effectiveness of small arms fire, shrapnel, knife blades and other hazards, the metals, ceramics and synthetic fiber materials are typically not particularly useful in connection with protection against blast or shockwaves and, in fact, as discussed above, may actually magnify injuries related to blast or shockwaves in some cases.

Metamaterial is an example of a material that may be configured to perform as shock penetration resistant material. In particular, acoustic metamaterial having a negative elastic modulus and/or a negative effective density may be useful as shock penetration resistant material. In this regard, acoustic waves that are generated responsive to a blast (e.g., shockwaves) do not propagate inside a material that has either a negative elastic modulus or a negative effective density. Thus, a shockwave that encounters acoustic metamaterial having a negative elastic modulus and/or a negative effective density may decay and essentially become harmless when attempting to pass through corresponding acoustic metamaterial. Accordingly, for example, if a helmet or vest were lined with or otherwise had acoustic metamaterial having a negative elastic modulus and/or a negative effective density embedded therein, a shockwave impacting the helmet or vest would be attenuated or redirected to prevent damage to vital organs of the wearer of the helmet or vest.

Acoustic metamaterial having a negative elastic modulus $\kappa$ and/or a negative effective density $\rho$ may exhibit desirable acoustic properties based on the acoustic wave equation:

$$\nabla \cdot \left(\frac{1}{\rho} \nabla p\right) + \frac{1}{\rho c_s^2} \frac{\partial^2 p}{\partial t^2} = Q,$$

where $\nabla p$ is a pressure vector, p represents pressure and t represents time. An acoustic wave does not propagate inside a material that has either a negative elastic modulus $\kappa$ or a negative effective density $\rho$. Accordingly, an acoustic wave encountering such a material is rendered substantially harmless. Control over the negative elastic modulus $\kappa$ and the negative effective density $\rho$ during design may enable the production of shock penetration resistant material that has desired properties such as substantial invisibility to a shockwave or reflection or redirection of the shockwave (e.g., when the acoustic impedance $\rho c_s$ is very different from that of air).

Figure 1A:
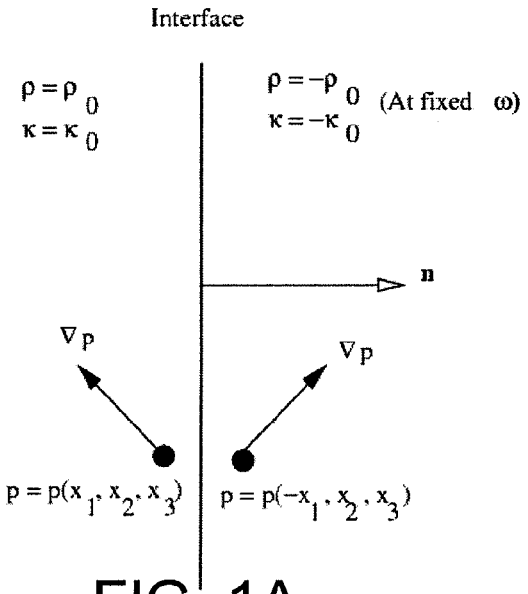
Figure 1B:
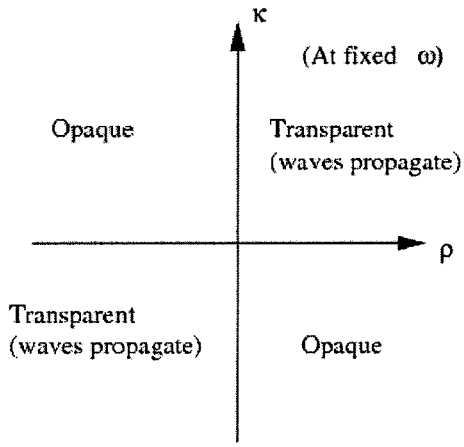

FIG. 1, which is defined by FIGS. 1A and 1B, shows the propagation of acoustic waves across an interface. As shown in FIG. 1A, if pressure is the same at points that are at equal distances from the interface, the pressure vectors shown may be reflections of each other. Furthermore, the boundary condition across the interface may be physical. FIG. 1B shows a plot of elastic modulus $\kappa$ versus effective density $\rho$. As can be seen from FIG. 1B, quadrants of the plot represent materials with various different combinations of elastic modulus $\kappa$ and effective density $\rho$. The top right quadrant represents materials with a positive elastic modulus $\kappa$ and a positive effective density $\rho$. Materials in the bottom right quadrant have a negative elastic modulus $\kappa$ and a positive effective density $\rho$. Meanwhile, materials in the bottom left quadrant have both a negative elastic modulus $\kappa$ and a negative effective density $\rho$, while materials in the top left quadrant have a positive elastic modulus $\kappa$ and a negative effective density $\rho$. As indicated above, materials having a negative elastic modulus $\kappa$ and/or a negative effective density $\rho$ may be useful as examples of shock penetration resistant materials.

Figure 2A:
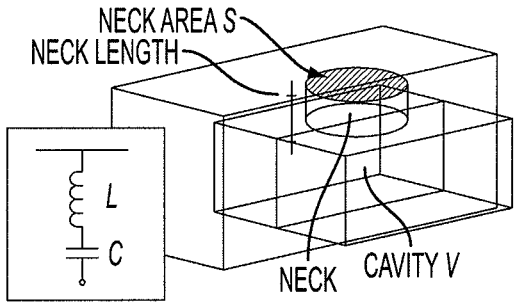
Figure 2B:
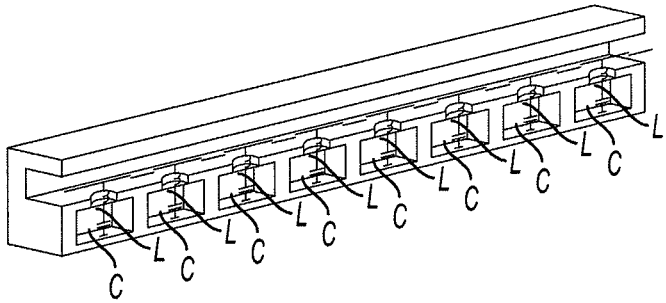
Figure 2C:
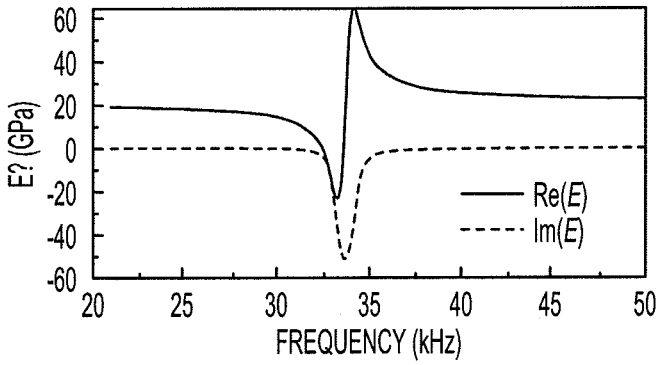

Accordingly, based on the descriptions herein, some example embodiments may be provided with shock penetration resistant material that is formed from acoustic metamaterial (e.g., material in a quadrant of FIG. 1B that has at least a negative elastic modulus $\kappa$ or a negative effective density $\rho$). However, in some alternative embodiments, shock penetration resistant materials may be formed of layers of materials that are not necessarily acoustic metamaterial (e.g., material in the quadrant of FIG. 1B that has a positive elastic modulus $\kappa$ and a positive effective density $\rho$). FIG. 2, which is defined by FIGS. 2A, 2B and 2C, illustrates an acoustic metamaterial of one example embodiment. In this regard, FIG. 2B shows a series or array of Helmholtz resonators, while FIG. 2A illustrates a cross section view of one of the Helmholtz resonators of FIG. 2B. In an example embodiment, each Helmholtz resonator may include a neck area and a cavity defined within an aluminum sample. The cavity may be rectangular (in this case having dimensions that are about 3.14 mm by 4 mm by 5 mm). The neck may be cylindrical in shape with a 1 mm diameter and a 1 mm length. The cavity and neck may be filled with water and be connected to a water duct that may have a cross section of about 4 mm by 4 mm. The resonators may be positioned with a periodicity of about 9.2 mm. By way of analogy, fluidic inductance may be provided due to the neck and acoustic capacitance may be provided due to the cavity. FIG. 2C illustrates the real and imaginary components of the effective bulk modulus of the Helmholtz resonators of FIGS. 2A and 2B as a function of frequency. Note that size, shape and material in which the Helmholtz resonator is formed and the fluid with which it is filled may be different in other embodiments.

Thus, in some embodiments, protective gear may be provided with acoustic metamaterial such as the metamaterial shown in FIG. 2 in order to provide shock penetration resistant properties to the protective gear. As an example, the acoustic metamaterial may be a filling material attached to the interior portion of a helmet or piece of armor to substantially render the wearer invisible to shockwaves. The acoustic metamaterial may include an array (e.g., a two dimensional array) of Helmholtz resonators as indicated in FIG. 2. However, some alternative embodiments may employ rubber ring inclusions, rubber coated metal spheres, rubber rods or other acoustic metamaterial structures. Generally speaking, rubber rods and rubber coated metal spheres may be examples of acoustic metamaterials with a negative effective density ρ. Meanwhile, rubber ring inclusions and rubber coated metal spheres may be examples of acoustic metamaterials that may have a negative elastic modulus κ. Acoustic metamaterial with a negative index of refraction for acoustics may therefore be employed in a unit cell approach to provide a cloaking device with respect to acoustic pressure or shockwaves.

Figure 3:
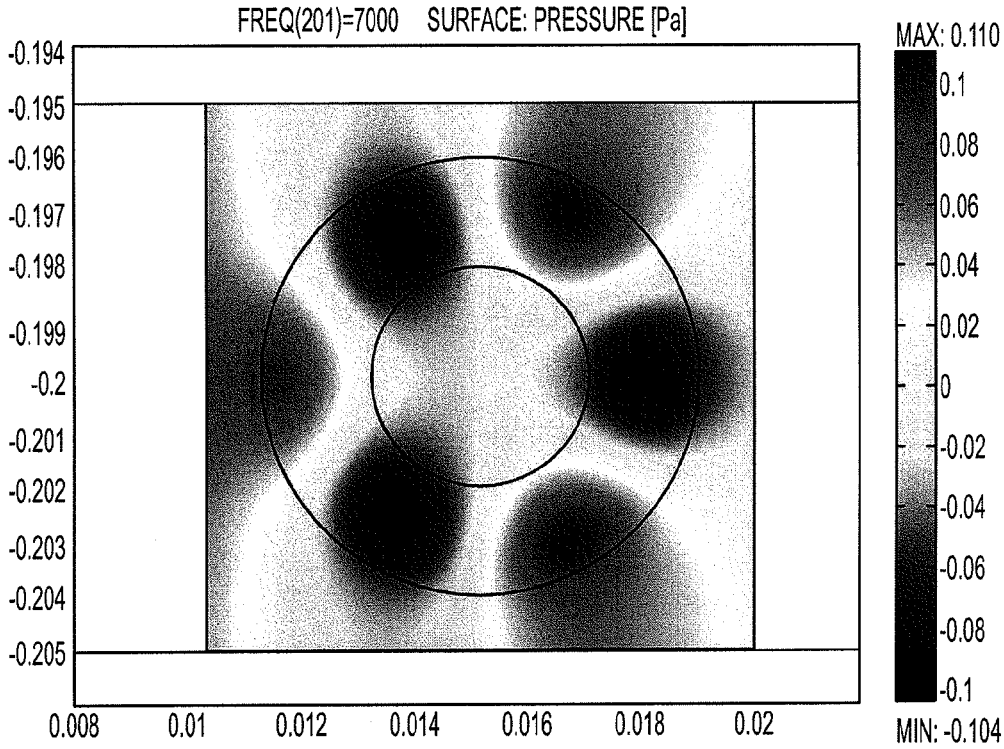
FIG. 3 illustrates a simulation of a pressure map for a material with a negative elastic modulus $\kappa$ according to an example embodiment.
Figure 4:
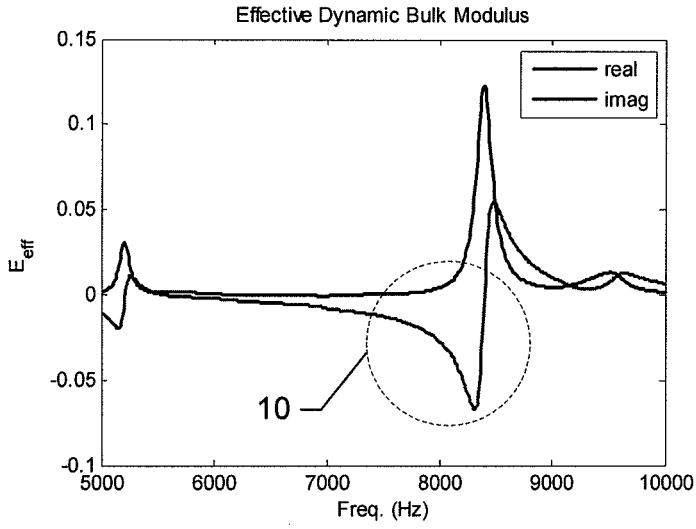
FIG. 4 illustrates a plot of the effective dynamic bulk modulus of an acoustic metamaterial according to an example embodiment.
Figure 5:
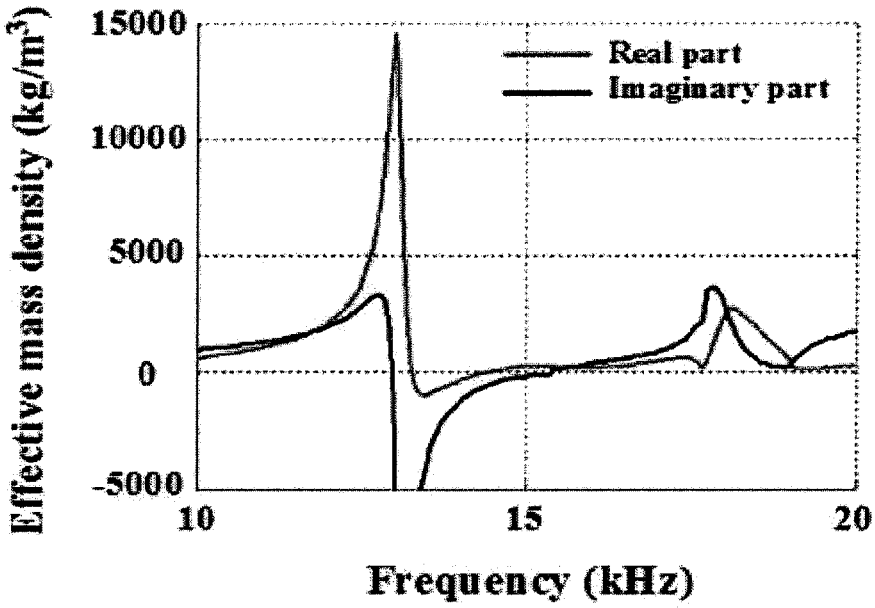
FIG. 5 illustrates a region over which the real portion of the effective mass density of a material is negative according to an example embodiment.

FIG. 3 illustrates a simulation of a pressure map for a material with a negative elastic modulus κ according to an example embodiment. The pressure map of FIG. 3, which shows very low pressure at the center, may be achieved using rubber ring inclusions or rubber coated metal spheres in acoustic metamaterial. The geometry of the acoustic metamaterial may determine resonance for the acoustic metamaterial and will therefore define a bandwidth over which the acoustic metamaterial is effective at essentially cloaking an object with respect to a pressure wave. FIG. 4 illustrates a plot of the effective dynamic bulk modulus of an acoustic metamaterial. As can be seen from FIG. 4, an operating range 10 over which real portions of the effective dynamic bulk modulus is a negative value is defined over a specific bandwidth. Thus, for example, knowing the operating range over which a particular structure provides cloaking properties, acoustic metamaterials having specific operating ranges may be selected for use to protect against specific types of blast or shockwaves. The image of FIG. 5 illustrates a region over which the real portion of the effective mass density of a material is negative as well. The arrangement of materials, the specific materials used and the frequencies over which they operate are all factors that may impact the behavior of a material with respect to a shockwave and are therefore considered with respect to selection of materials for use in connection with providing a shock penetration resistant material using acoustic metamaterial according to some example embodiments.

By controlling the elastic modulus κ and the effective density ρ, properties of the shock penetration resistant material may be flexibly controlled. For example, by controlling both the negative elastic modulus κ and the negative effective density ρ, the acoustic impedance of the shock penetration resistant material may be made very different from that of air to enable the shock penetration resistant material to reflect significant portions of shockwave energy. Similarly, by controlling both the negative elastic modulus κ and the negative effective density ρ, the acoustic impedance of the shock penetration resistant material may be made such that an acoustic cloaking device that renders objects inside to be substantially invisible to shockwave energy results.

As indicated above, some embodiments may employ shock penetration resistant materials that may be formed of layers of materials that are not necessarily acoustic metamaterial (e.g., material in the quadrant of FIG. 1B that has a positive elastic modulus κ and a positive effective density ρ and therefore does not have a negative index of refraction for acoustics). In some cases, embodiments employing shock penetration resistant materials that may be formed of layers of materials that are not necessarily acoustic metamaterial may be somewhat less compact than those embodiments that employ acoustic metamaterial (e.g., unit cell approach based embodiments) due to the need for multiple layers. When employed in shock penetration resistant materials, the layers of materials approach may present a positive index of refraction for acoustics, but may still provide a gradient index that achieves the result of providing cloaking properties.

Figure 6:
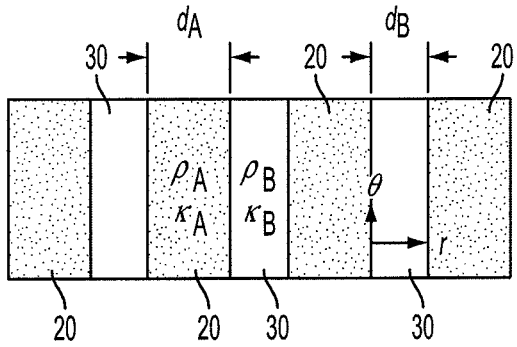
FIG. 6 illustrates a layered series of instances of material A and material B, each of which is not an acoustic metamaterial according to an example embodiment.

In some embodiments, the gradient index may be a function of radius. FIG. 6 illustrates a layered series of instances of material A (layer 20) and material B (layer 30), each of which is not an acoustic metamaterial. Material A and material B may each have different densities of moduli. Accordingly, with thicknesses of the materials being provided to be smaller than the wavelength of a pressure wave, the effective mass density and moduli of the layered material may be given by the equation:

$$\rho_r = \frac{\rho_A + \eta\rho_B}{1+\eta},$$

$$\frac{1}{\rho_\theta} = \frac{1}{1+\eta}\left(\frac{1}{\rho_A} + \frac{\eta}{\rho_B}\right)$$

$$\frac{1}{\kappa} = \frac{1}{1+\eta}\left(\frac{1}{\kappa_A} + \frac{\eta}{\kappa_B}\right),$$

where $\eta(=d_B/d_A)$ is ratio of thicknesses

In embodiments employing an example similar to that of FIG. 6 (e.g., a layered approach), the use of layered materials may provide a relatively wider bandwidth over which protection is offered than perhaps a unit cell approach. In this regard, while an acoustic metamaterial may be effective over a frequency range that is determined based on properties of the acoustic metamaterial, the materials selected for the layers of material may be selected as wideband materials to provide a relatively wide bandwidth over which the shock penetration resistant material is effective.

Figure 7:
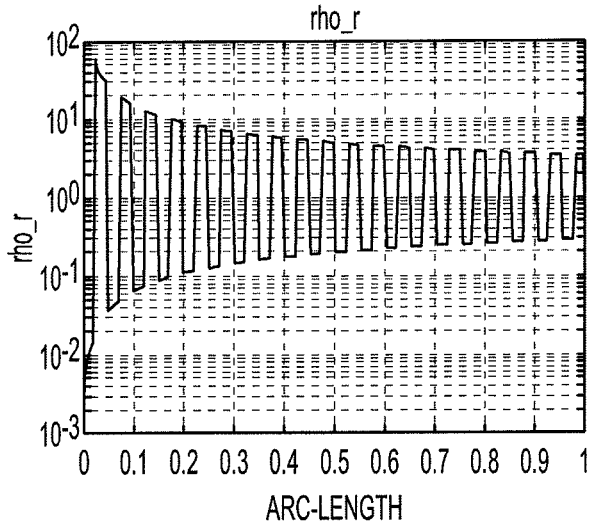
FIG. 7 illustrates a ratio of effective density $\rho$ to the effective density $\rho_0$ of air plotted against material radius of a shell according to an example embodiment.

FIG. 7 illustrates an example embodiment in which, from transformation optics techniques, example material requirements for a cloaking helmet are shown. FIG. 7 illustrates a ratio of effective density ρ to the effective density of air $\rho_0$ plotted against material radius of a shell (e.g., inner radius being on the left and outer radius being on the right). An example realization of a cloaking helmet with forty layers of material alternating between more and less dense material is shown in FIG. 8A. Density requirements range from 0.01× density of air to 100× (assuming operation in air, otherwise air may be replaced with water or some other fluid). A less dense material may be a partial vacuum between denser materials in some example embodiments. Denser materials used to form layers may include, for example, foam, rubber, plastic and other materials that have densities that can be controlled during the injection, forming or compression process. As shown in FIG. 8A, a "cloaking shell" 50 may form around a cloaked object to cause the blast wave to pass harmlessly around the cloaked object. FIG. 8B shows a simulation of the cloaking shell 50 formed around the cloaked object in a scenario in which two hundred layers of alternating more and less dense materials are employed according to another example embodiment.

FIG. 9 illustrates a diagram showing a portion of a human body as a protected object that is equipped with protective gear. In this example, the protected object is a head 100 and the protective gear is a hemispherical shell shaped helmet 110 worn on the head 100. The helmet 110 may include a shock penetration resistant material 120 that may be coupled to a portion of the helmet 110 that is proximate to the head 100. In this example, the head 100 (or at least the portion of the head that is proximate to the shock penetration resistant material 120) may be considered a cloaked object since the shock penetration resistant material 120 may be enabled to attenuate or redirect acoustic pressure directed thereat. Accordingly, for example, if a soldier wearing the helmet 110 is near a blast that produces a shockwave, the shockwave will not be focused on the head 100 in the manner in which such focusing may occur in connection with conventional helmets. Instead, the shock penetration resistant material 120 may protect the head 100 from the shockwave as described above.

In some embodiments, the shock penetration resistant material 120 may be a liner or lining material affixed to an interior portion of the helmet 110. However, it may also be possible to wear the shock penetration resistant material 120 as a form fitting hat that may fit under the helmet 110. Similarly, shock penetration resistant material that is used in connection with other garments or armor portions may be affixed to the corresponding garment or armor portion, or may be worn or affixed to a portion of the protected object (e.g., a body part or piece of equipment) between the protected object and the garment or armor portion. The shock penetration resistant material used in various example embodiments could alternatively be incorporated into the protective gear such as being positioned at an exterior portion of the protective gear, or being positioned within a portion of the protective gear (e.g., sandwiched between other components of the protective gear). As such, the shock penetration resistant material (e.g., acoustic metamaterial or layered materials with alternating different densities and selected thicknesses) may attenuate or redirect (e.g., via refraction or cloaking) a shockwave to protect vital organs and/or equipment from damage that the shockwave might otherwise cause. Moreover, the pressure wave focusing tendencies of conventional helmets and perhaps also other conventional protective gear may be overcome.

FIG. 10 illustrates a method of providing protective gear that has improved effectiveness against shock pulses and bomb blasts according to an example embodiment. The method may include providing an item of protective gear to be positioned proximate to an object to be protected at operation 200, and disposing a shock penetration resistant material proximate to the item of protective gear to attenuate or redirect shock pulses away from the object to be protected at operation 210.

In some embodiments, certain ones of the operations above may be modified or further amplified as described below. Moreover, in some embodiments additional optional operations may also be included (an example of which is shown in dashed lines in FIG. 10). It should be appreciated that each of the modifications, optional additions or amplifications below may be included with the operations above either alone or in combination with any others among the features described herein. In this regard, for example, the method may further include controlling the negative elastic modulus and negative effective density of the shock penetration resistant material to make acoustic impedance of the shock penetration resistant material substantially different from acoustic impedance of air to enable the shock penetration resistant material to be reflective of shockwave energy or to make acoustic impedance of the shock penetration resistant material such that the object to be protected is substantially invisible to shockwave energy at operation 220. In some cases, disposing the shock penetration resistant material may include disposing an acoustic metamaterial (e.g., an array of Helmholtz resonators, rubber ring inclusions, rubber rods or rubber coated spheres) proximate to the item of protective gear. In some embodiments, disposing the acoustic metamaterial may include disposing a material having one or both of a negative elastic modulus and a negative effective density proximate to the item of protective gear. In an example embodiment, disposing the shock penetration resistant material may include disposing alternating layers of materials having respective different densities of moduli and selected respective thicknesses of each material in which the selected respective thicknesses are smaller than a wavelength of a particular pressure wave. In an example embodiment, disposing the shock penetration resistant material proximate to the item of protective gear may include affixing the shock penetration resistant material to an interior portion of the item of protective gear or disposing the shock penetration resistant material between portions of the item of protective gear.

Many modifications and other embodiments of the disclosure set forth herein will come to mind to one skilled in the art to which these embodiments pertain having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus comprising:

an item of protective gear configured to be positioned proximate to an object to be protected; and a shock penetration resistant material disposed proximate to the item of protective gear to attenuate or redirect shock pulses away from the object to be protected, wherein the shock penetration resistant material comprises an acoustic metamaterial comprised of an array of Helmholtz resonators, rubber ring inclusions, rubber rods or rubber coated spheres.

2. The apparatus of claim 1, wherein the item of protective gear is a helmet, vest or portion of body armor for protecting vital organs of a wearer.

3. The apparatus of claim 1, wherein the item of protective gear is a portion of armor for protecting a vehicle, robot, mechanical component or electrical component.

4. An apparatus comprising:

an item of protective gear configured to be positioned proximate to an object to be protected; and a shock penetration resistant material disposed proximate to the item of protective gear to attenuate or redirect shock pulses away from the object to be protected, wherein the shock penetration resistant material comprises an acoustic metamaterial comprising a material having one or both of a negative elastic modulus and a negative effective density.

5. The apparatus of claim 4, wherein the negative elastic modulus and negative effective density of the shock penetration resistant material is selectable to make acoustic impedance of the shock penetration resistant material different from acoustic impedance of air to enable the shock penetration resistant material to be reflective of shockwave energy.

6. The apparatus of claim 4, wherein the negative elastic modulus and negative effective density of the shock penetration resistant material is selectable to make acoustic impedance of the shock penetration resistant material such that the object to be protected is substantially invisible to shockwave energy.

7. An apparatus comprising:

an item of protective gear configured to be positioned proximate to an object to be protected; and a shock penetration resistant material disposed proximate to the item of protective gear to attenuate or redirect shock pulses away from the object to be protected, wherein the shock penetration resistant material comprises alternating layers of materials having respective different densities of moduli, wherein the alternating layers of materials include selected respective thicknesses of each material, the selected respective thicknesses being smaller than a wavelength of a particular pressure wave, wherein the material from which the alternating layers of materials are selected includes wide bandwidth materials.

8. An apparatus comprising:

an item of protective gear configured to be positioned proximate to an object to be protected; and a shock penetration resistant material disposed proximate to the item of protective gear to attenuate or redirect shock pulses away from the object to be protected, wherein the shock penetration resistant material comprises alternating layers of materials having respective different densities of moduli, wherein the alternating layers of materials include selected respective thicknesses of each material, the selected respective thicknesses being smaller than a wavelength of a particular pressure wave, wherein the alternating layers of materials include materials having a positive index of refraction, but a gradient index selected as a function of radius to have a resistance to penetration of shock waves.

9. A method for providing a shock penetration resistant apparatus comprising:

providing an item of protective gear to be positioned proximate to an object to be protected; and disposing a shock penetration resistant material proximate to the item of protective gear to attenuate or redirect shock pulses away from the object to be protected, wherein disposing the shock penetration resistant material comprises disposing an acoustic metamaterial proximate to the item of protective gear by disposing acoustic metamaterial including an array of Helmholtz resonators, rubber ring inclusions, rubber rods or rubber coated spheres proximate to the item of protective gear.

10. The method of claim 9, wherein disposing the shock penetration resistant material proximate to the item of protective gear comprises affixing the shock penetration resistant material to an interior portion of the item of protective gear.

11. The method of claim 9, wherein disposing the shock penetration resistant material proximate to the item of protective gear comprises disposing the shock penetration resistant material between portions of the item of protective gear.

12. A method for providing a shock penetration resistant apparatus comprising:

providing an item of protective fear to be positioned proximate to an object to be protected; and disposing a shock penetration resistant material proximate to the item of protective gear to attenuate or redirect shock pulses away from the object to be protected, wherein disposing the shock penetration resistant material comprises disposing an acoustic metamaterial proximate to the item of protective gear by disposing a material having one or both of a negative elastic modulus and a negative effective density proximate to the item of protective gear.

13. The method of claim 12, further comprising controlling the negative elastic modulus and negative effective density of the shock penetration resistant material to make acoustic impedance of the shock penetration resistant material substantially different from acoustic impedance of air to enable the shock penetration resistant material to be reflective of shockwave energy or to make acoustic impedance of the shock penetration resistant material such that the object to be protected is substantially invisible to shockwave energy.

* * * * *